US010508786B2

(12) United States Patent
Guan et al.

(10) Patent No.: US 10,508,786 B2
(45) Date of Patent: Dec. 17, 2019

(54) VEHICLE LAMP WITH PROJECTOR LENS, REFLECTOR, SHIELD AND GRATING PLATE WITH EXTENSION DISPOSED BELOW THE OPTICAL AXIS AND IN FRONT OF THE REAR FOCAL POINT OF THE LENS

(71) Applicant: Hua Xin Optronics Co., Hsinchu (TW)

(72) Inventors: You-Kang Guan, Miaoli County (TW); I-Liang Huang, Hsinchu (TW)

(73) Assignee: Hua Xin Optronics Co., Hsinchu (TW)

( * ) Notice: Subject to any disclaimer, the term of this patent is extended or adjusted under 35 U.S.C. 154(b) by 0 days.

(21) Appl. No.: 16/372,293

(22) Filed: Apr. 1, 2019

(65) Prior Publication Data

US 2019/0301695 A1 Oct. 3, 2019

(30) Foreign Application Priority Data

Apr. 3, 2018 (TW) ..... 107111934 A

(51) Int. Cl.

| | |
|---|---|
| ***F21S 41/30*** | (2018.01) |
| ***F21S 41/143*** | (2018.01) |
| ***F21S 41/147*** | (2018.01) |
| ***F21S 41/275*** | (2018.01) |
| ***F21S 41/29*** | (2018.01) |
| ***F21S 41/692*** | (2018.01) |
| ***F21S 41/255*** | (2018.01) |
| *F21S 41/43* | (2018.01) |

(52) U.S. Cl.

CPC ..... *F21S 41/30* (2018.01); *F21S 41/143* (2018.01); *F21S 41/147* (2018.01); *F21S 41/255* (2018.01); *F21S 41/275* (2018.01); *F21S 41/295* (2018.01); *F21S 41/692* (2018.01); *F21S 41/43* (2018.01)

(58) Field of Classification Search

CPC ..... F21S 41/147; F21S 41/148; F21S 41/30; F21S 41/141; F21S 41/692

See application file for complete search history.

(56) References Cited

U.S. PATENT DOCUMENTS

| | | | | |
|---|---|---|---|---|
| 7,736,036 | B2 | 6/2010 | Tatsukawa | |
| 2019/0242543 | A1* | 8/2019 | Guan | B60Q 1/04 |

FOREIGN PATENT DOCUMENTS

| | | | |
|---|---|---|---|
| CN | 206386838 | U | 8/2017 |
| TW | 201144666 | A | 12/2011 |
| TW | 201706540 | A | 2/2017 |

OTHER PUBLICATIONS

Search Report appended to an Office Action, which was issued to Taiwanese counterpart application No. 107111934 by the TIPO dated Jul. 19, 2018, with an English translation thereof.

* cited by examiner

*Primary Examiner* — Robert J May

(57) ABSTRACT

A vehicle lamp adapted to be installed on a vehicle includes a projector lens, a reflector, a light emitting element, and a grating plate. The projector lens has a light entry surface and alight exit surface. The light emitting element is disposed for emitting light towards the reflector, such that the light is reflected by the reflector to pass through the projector lens to form a light distribution pattern. The grating plate is for reflecting at least a portion of the light that has traveled ahead of a second focal point of the reflector and that has not passed through the light exit surface of the projector lens. An extension of the grating plate and the optical axis defines an angle between 0 degree and 45 degrees.

10 Claims, 8 Drawing Sheets

VEHICLE LAMP WITH PROJECTOR LENS, REFLECTOR, SHIELD AND GRATING PLATE WITH EXTENSION DISPOSED BELOW THE OPTICAL AXIS AND IN FRONT OF THE REAR FOCAL POINT OF THE LENS

CROSS-REFERENCE TO RELATED APPLICATION

This application claims priority of Taiwanese Patent Application No. 107111934, filed on Apr. 3, 2018.

FIELD

The disclosure relates to a vehicle lamp, more particularly to a vehicle lamp with a grating plate.

BACKGROUND

A conventional vehicle lamp is disclosed in U.S. Pat. No. 7,736,036. FIGS. 2 and 5 of U.S. Pat. No. 7,736,036 are referred to in the following description.

The conventional vehicle lamp includes a projector lens 12, a light emitting element 14, and a reflector 16. The projector lens 12 defines an optical axis (Ax) extending in a front-rear direction, and includes front and rear side surfaces 12*a*, 12*b* spaced apart along the optical axis (Ax). The light emitting element 14 is proximal to a rear focal point (F) of the projector lens 12. The reflector 16 reflects light from the light emitting element 14. The front side surface 12*a* is formed with a plurality of lens elements 12As, 12Bs extending substantially in a horizontal direction and spaced apart vertically. An external surface of each of the lens elements 12As, 12Bs has a waveform shape. A light distribution pattern formed by the light radiating from the conventional vehicle lamp has a cutoff line.

The lens elements 12As, 12Bs are for diffracting light emitted by the light emitting element 14 when the light passes through the projector lens 12 such that light is diffracted to above the cutoff line, reducing discomfort for drivers in an oncoming vehicle.

However, the positions and angles of the lens elements 12As, 12Bs must be precisely controlled so that the diffracted light converge, otherwise the light may be over-diffracted, leading to an increase in brightness above the cutoff line or a decrease in brightness below the cutoff line, causing discomfort to the oncoming driver or producing insufficient lighting for the driver of the vehicle.

SUMMARY

Therefore, the object of the disclosure is to provide a vehicle lamp that can alleviate at least one of the drawbacks of the prior art.

According to the disclosure, the vehicle lamp is adapted to be installed on a vehicle, and includes a projector lens, a reflector, a light emitting element, a shield and a grating plate.

The projector lens is disposed on an optical axis which extends along a longitudinal direction of the vehicle, and has a light entry surface and a light exit surface that is opposite to the light entry surface.

The reflector is disposed on the optical axis at a position which is behind a rear focal point of the projector lens;

The light emitting element is adjacent to a first focal point of the reflector which is distal from the rear focal point of the projector lens, and is disposed for emitting light towards the reflector, such that the light is reflected by the reflector substantially toward a second focal point of the reflector which is proximate to the rear focal point of the projector lens, and to pass subsequently through the light entry surface and the light exit surface of the projector lens to form a light distribution pattern.

The shield is for blocking a portion of the light that is emitted from the light emitting element to form a cut-off line in the light distribution pattern.

The grating plate is disposed below the optical axis and in front of the rear focal point of the projector lens for reflecting at least a portion of the light that has traveled ahead of the second focal point of the reflector and that has not passed through the light exit surface of the projector lens. An extension of the grating plate and the optical axis defines an angle between 0 degree and 45 degrees.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
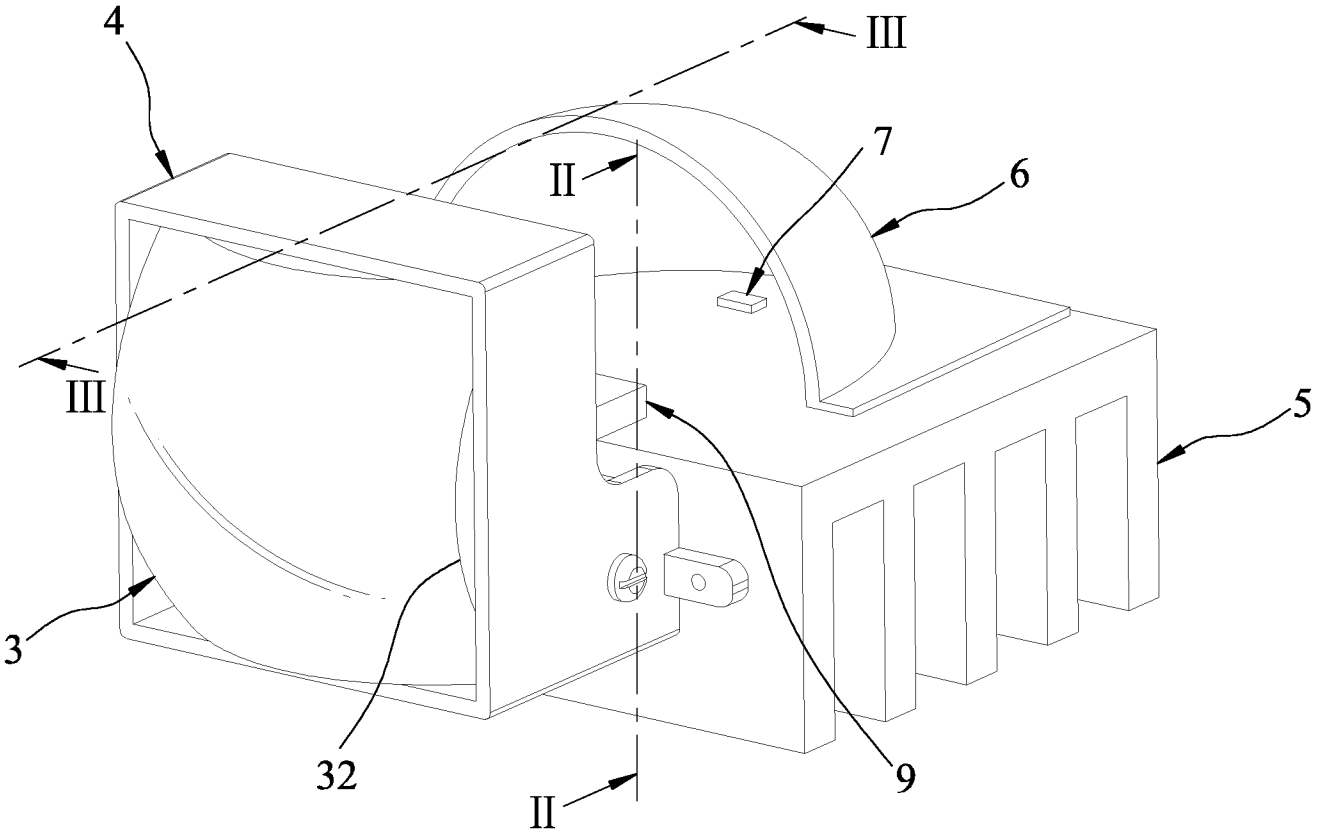
FIG. 1 is a perspective view of an embodiment of a vehicle lamp according to the disclosure.
Figure 2:
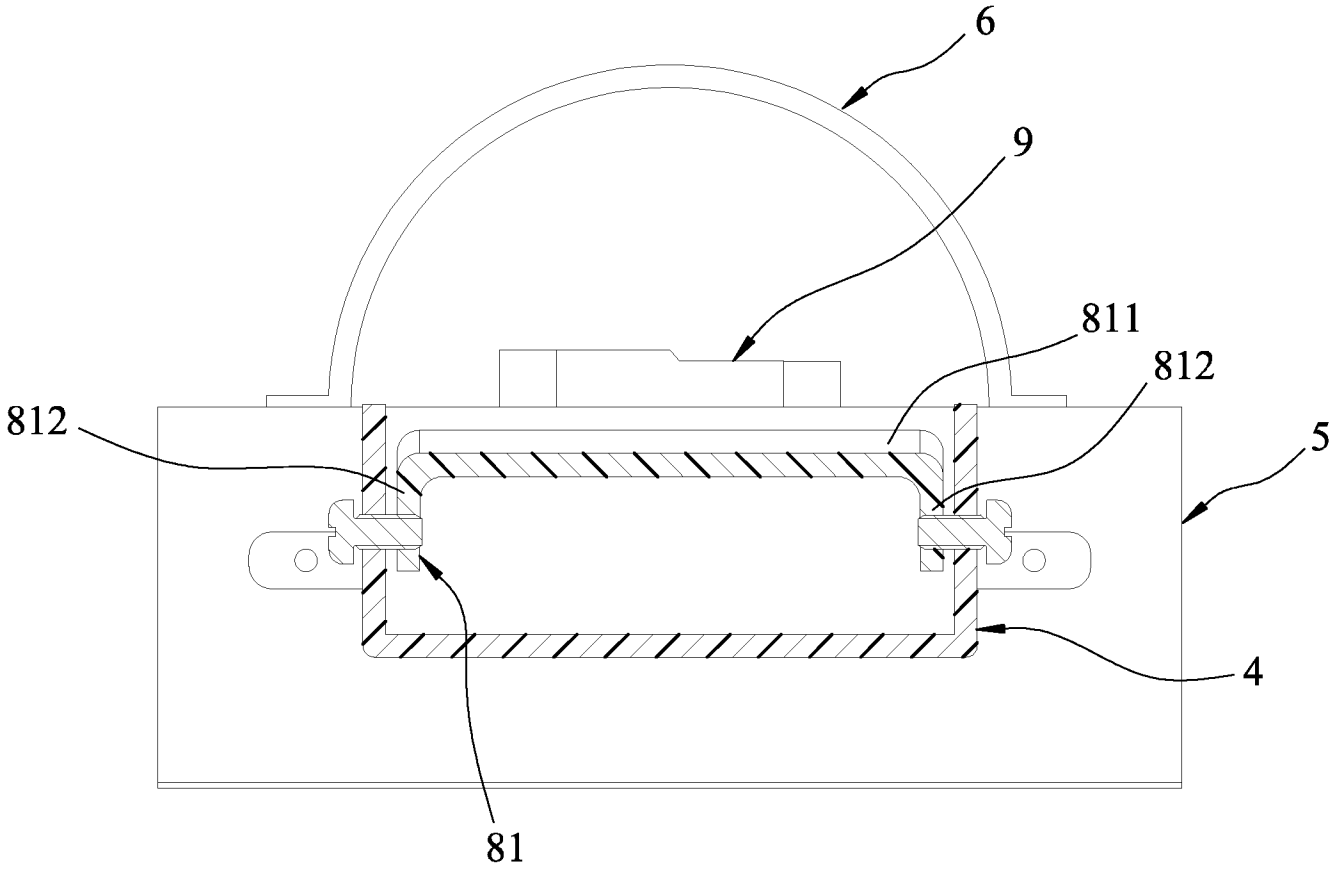
FIG. 2 is a sectional view taken along line II-II in FIG. 1.
Figure 3:
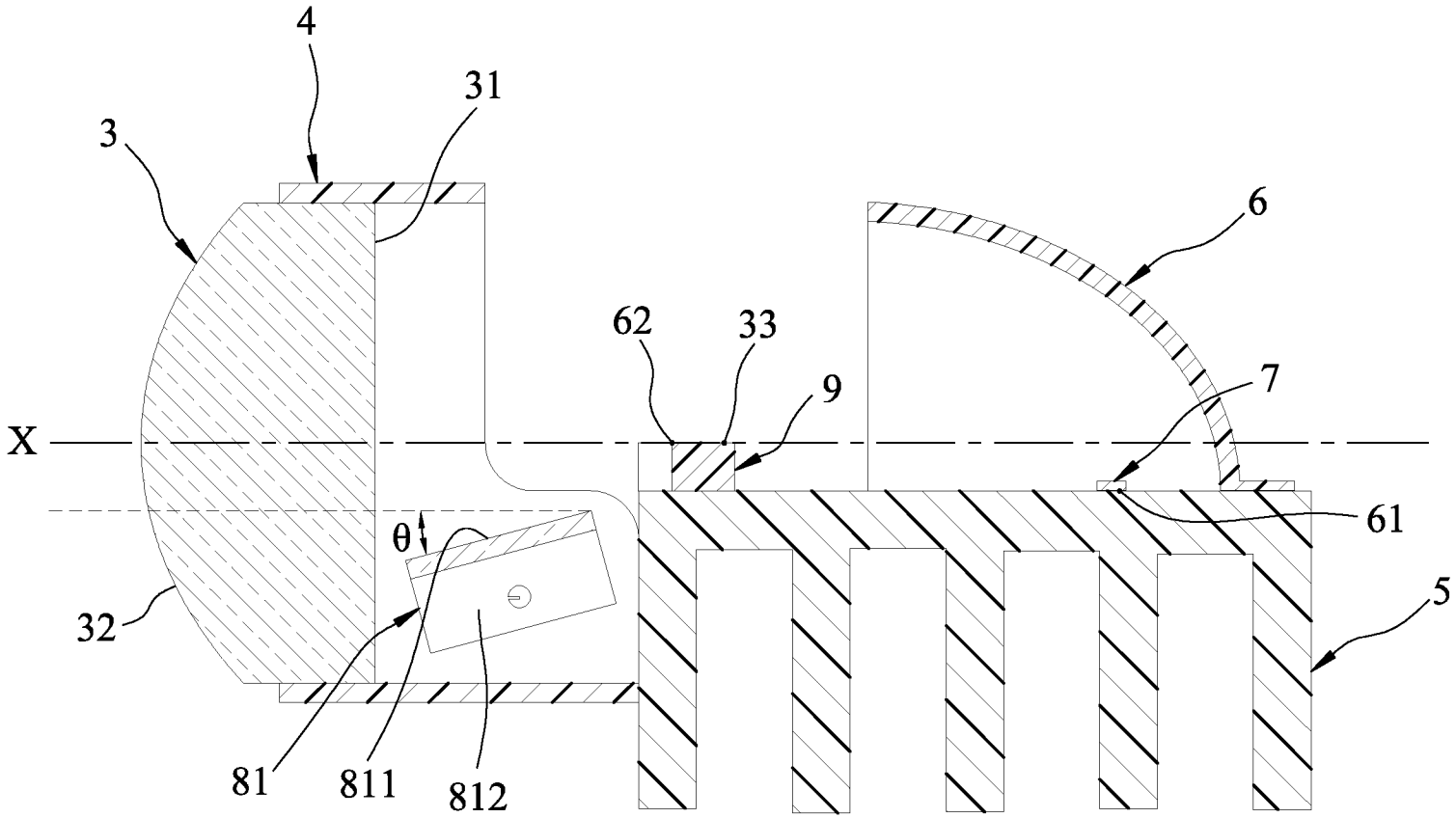
FIG. 3 is a sectional view taken along line III-III in FIG. 1, illustrating atop surface of a grating plate of the embodiment being a flat surface.

Referring to FIGS. 1, 2 and 3, an embodiment of a vehicle lamp according to the disclosure is adapted to be installed on a vehicle (not shown). The vehicle lamp includes a projector lens 3, a lens holder 4, a heat dissipating member 5, a reflector 6, a light emitting element 7, a grating plate 81, and a shield 9.

The projector lens 3 is disposed on an optical axis (X) which extends along a longitudinal direction of the vehicle, and has a light entry surface 31 and a light exit surface 32 that is opposite to the light entry surface 31.

In this embodiment, the projector lens 3 is a plano-convex lens. In variations of this embodiment, the projector lens 3 may be any lens that has a positive refractive index, e.g. a biconvex lens.

The lens holder 4 is mounted with the projector lens 3.

The heat dissipating member 5 is mounted with the lens holder 4, the reflector 6, the light emitting element 7 and the shield 9, and is for dissipating heat.

The reflector 6 is disposed on the optical axis (X) at a position which is behind a rear focal point 33 of the projector lens 3.

The light emitting element 7 is disposed below the optical axis (X). The light emitting element 7 is adjacent to a first focal point 61 of the reflector 6 which is distal from the rear focal point 33 of the projector lens 3, and is disposed for emitting light towards the reflector 6, such that the light is reflected by the reflector 6 substantially toward a second focal point 62 of the reflector 6 which is proximate to the rear focal point 33 of the projector lens 3, and to pass subsequently through the light entry surface 31 and the light exit surface 32 of the projector lens 3 to form a light distribution pattern.

In this embodiment, the light emitting element 7 is a light emitting diode constructed from at least one semi-conductor chip.

The grating plate 81 is disposed below the optical axis (X) and in front of the rear focal point 33 of the projector lens 3 for reflecting at least a portion of the light that has traveled ahead of the second focal point 62 of the reflector 6 and that has not passed through the light exit surface 32 of the projector lens 3.

Figure 4:
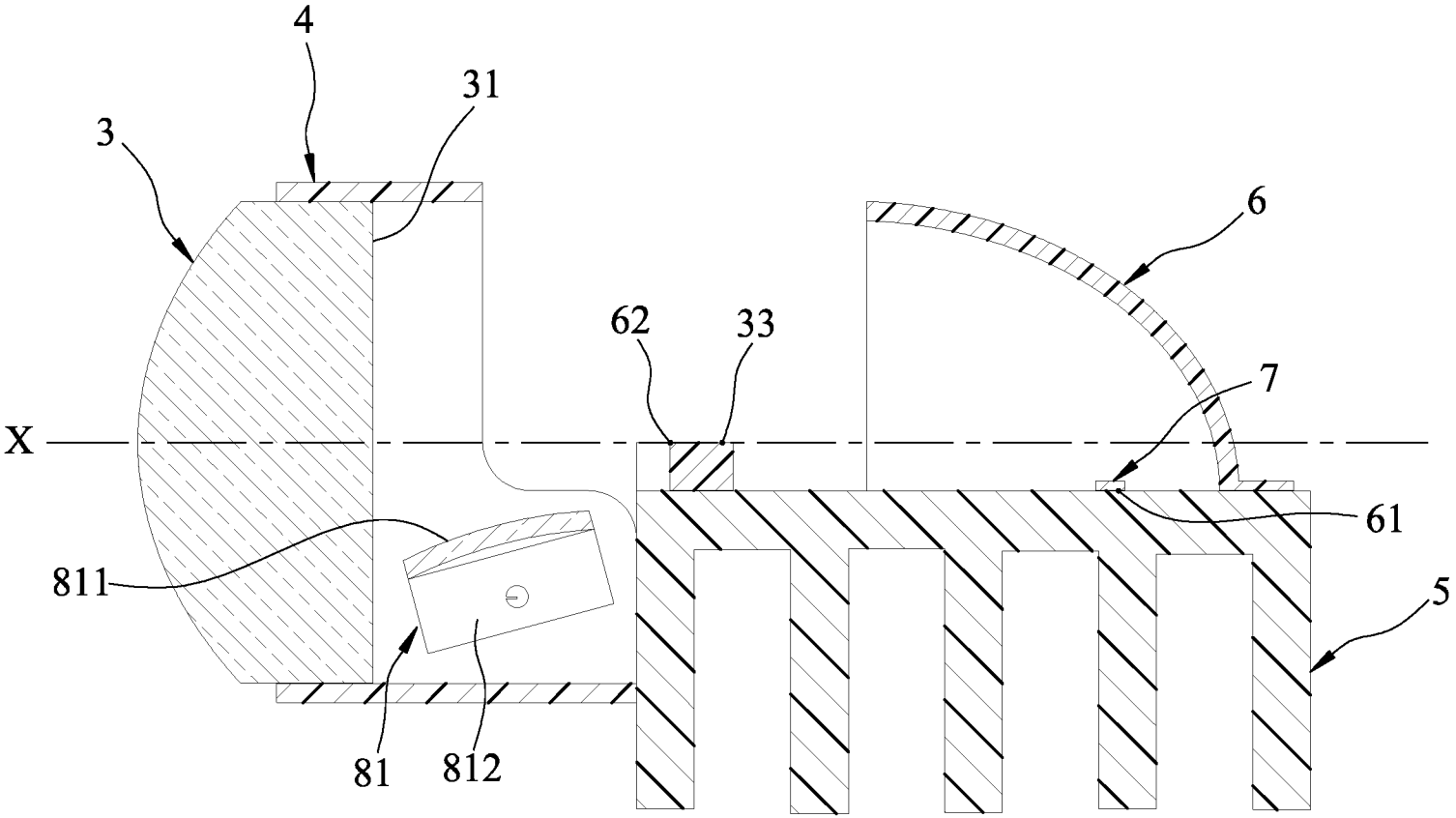
FIG. 4 is a sectional view similar to FIG. 3, but with the top surface being a concave curved surface.
Figure 5:
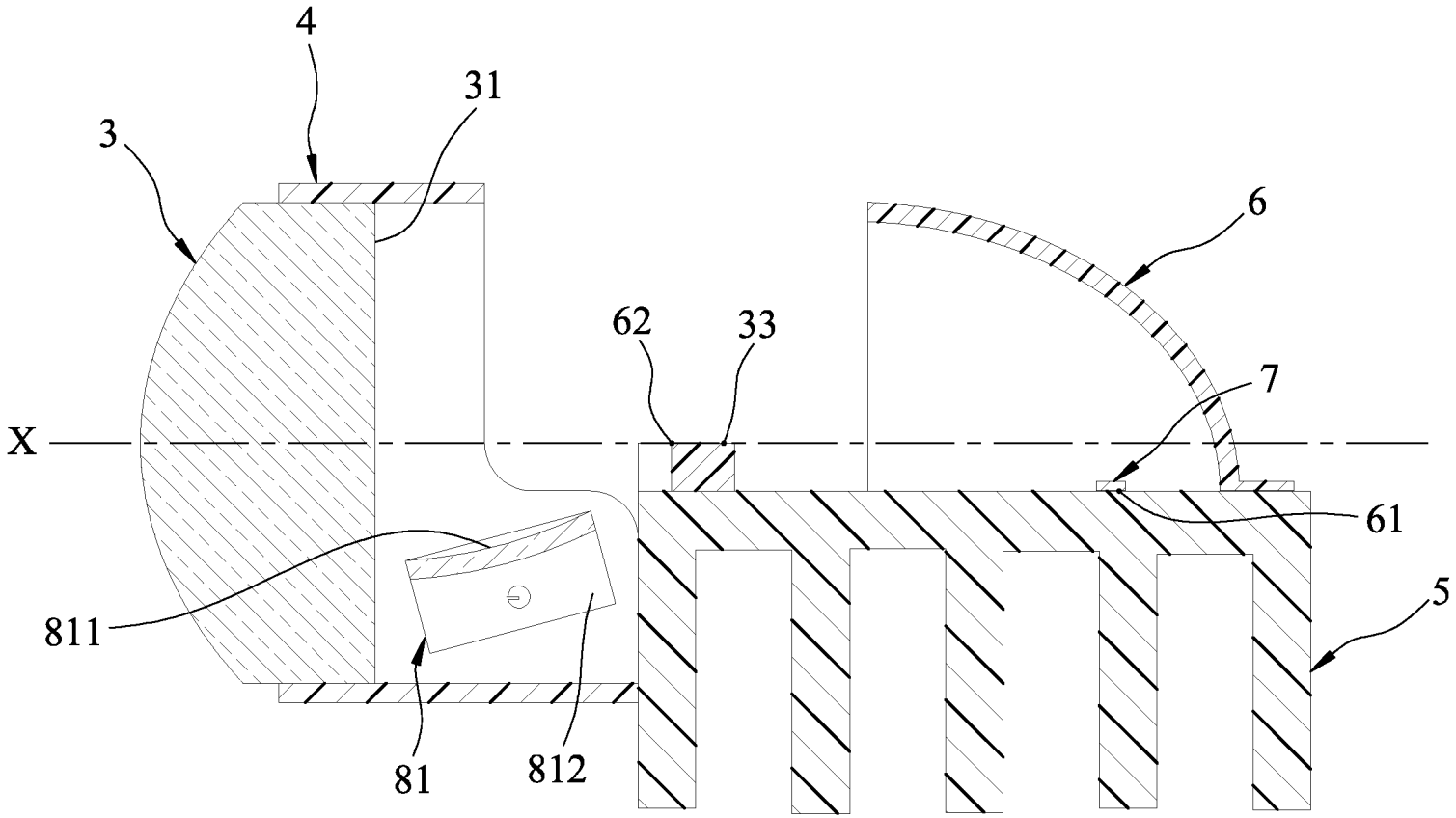
FIG. 5 is a sectional view similar to FIG. 3, but with the top surface being a convex curved surface.

Referring to FIGS. 2, 4, and 5, the grating plate 81 is substantially U-shaped and detachably and rotatably connected to the lens holder 4. The grating plate 81 has a transmittance of less than or equal to 80% for visible light having wavelength between 400 and 700 nanometers, and has a top portion and two lateral portions 812 connected respectively to opposite lateral ends of the top portion. The top portion has a top surface 811. In this embodiment, the top surface 811 is a flat surface. In variations of this embodiment, the top surface 811 may also be a curved surface, such as a convex curved surface (as shown in FIG. 4) or a concave curved surface (as shown in FIG. 5).

The two lateral portions 812 are directly and rotatably connected to the lens holder 4. The grating plate 81 is rotatable about a rotational axis which is normal to the optical axis (X). An extension of the top portion of the grating plate 81 and the optical axis (X) define an angle (θ) between 0 degree and 45 degrees. In certain embodiments, the angle (θ) is between 30 degrees and 40 degrees. In this embodiment, the angle (θ) is 32.5 degrees.

The shield 9 is for blocking a portion of the light that is emitted from the light emitting element 7 to form a cut-off line in the light distribution pattern.

Figure 6:
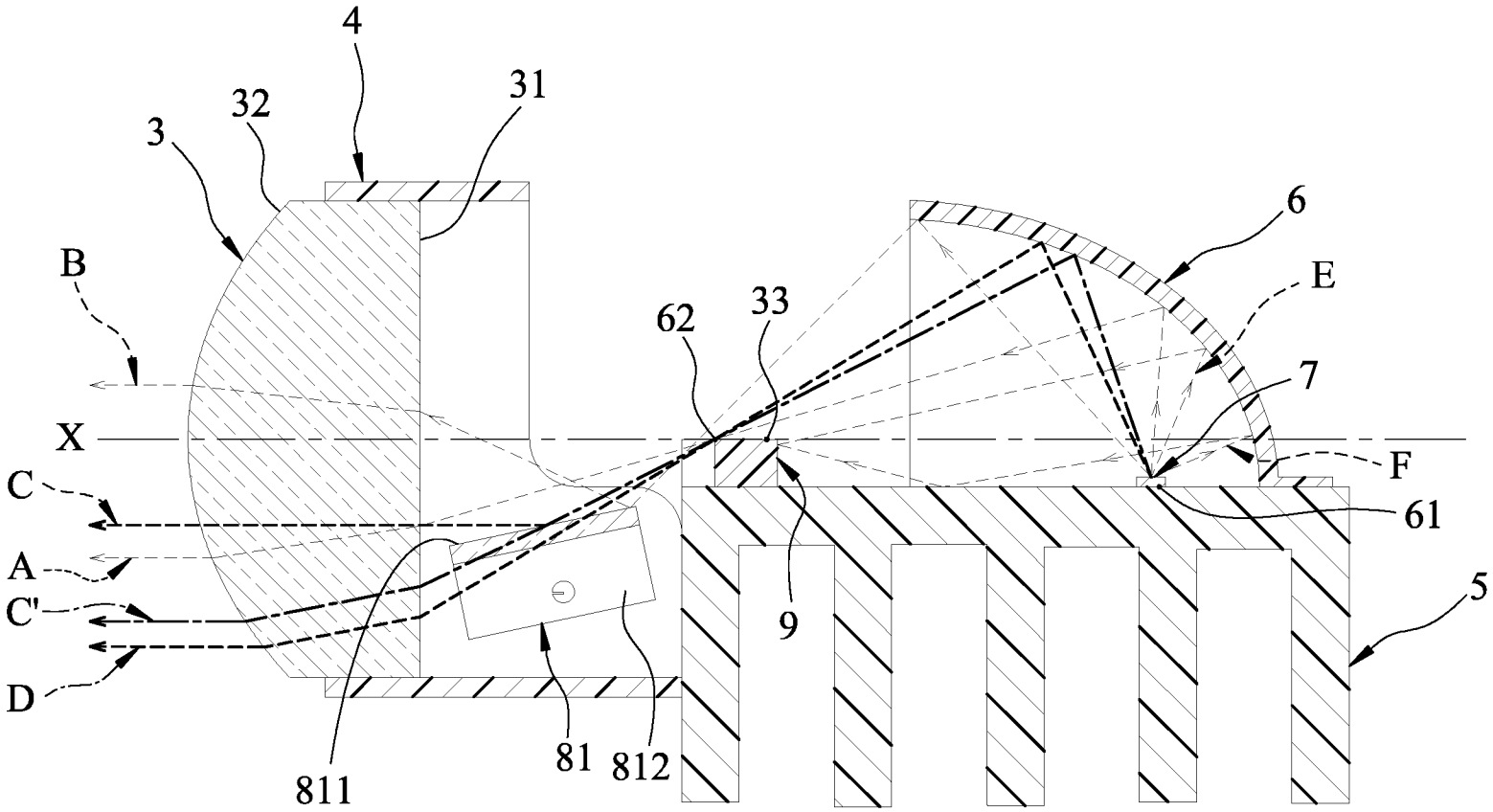
FIG. 6 is another sectional view of the embodiment, illustrating representative light rays.

Referring to FIGS. 3 and 6, the light emitting element 7 emits a plurality of light rays. For ease of illustration, only seven representative light rays (A, B, C, C', D, E and F) are shown.

The light rays (A, B, C, and D) are directed towards the light entry surface 31 after being reflected by the reflector 6. The light ray (A) does not pass through the grating plate 81 and exits from the light exit surface 32 after being refracted by the projector lens 3. The light rays (B, C, and D) are incident on the grating plate 81.

The light rays (B, C) represent a portion of the light reflected by the grating plate 81. The light ray (B) is directed to and exits from an upper portion of the light exit surface 32 after being refracted by the projector lens 3. The light ray (C) is directed to and exits from a lower portion of the light exit surface 32 after being refracted by the projector lens 3.

The light ray (C') represents a path of the light ray (C) with the omission of the grating plate 81. Specifically, even though the light ray (C') still is directed to and exits from the lower portion of the light exit surface 32, the position at which the light ray (C') exits from is further away from the optical axis (X) than that of the light ray (C). Hence the grating plate 81 allows the light ray (C) to be less dispersed than the light ray (C').

The light ray (D) represents a portion of the light refracted by the grating plate 81. After being refracted by the grating plate 81, the light ray (D) is incident on the light entry surface 31 and exits from the light exit surface 32 at a position further away from the optical axis (X) than the light ray (C).

The light ray (E) is directed towards and shielded by the shield 9 after being reflected by the reflector 6. The light ray (F) is first reflected by the reflector 6, then reflected by the heat dissipating member 5, and finally shielded by the shield 9. The light rays (E, F), being shielded by the shield 9, forms the cutoff line in the light distribution pattern.

Figure 7:
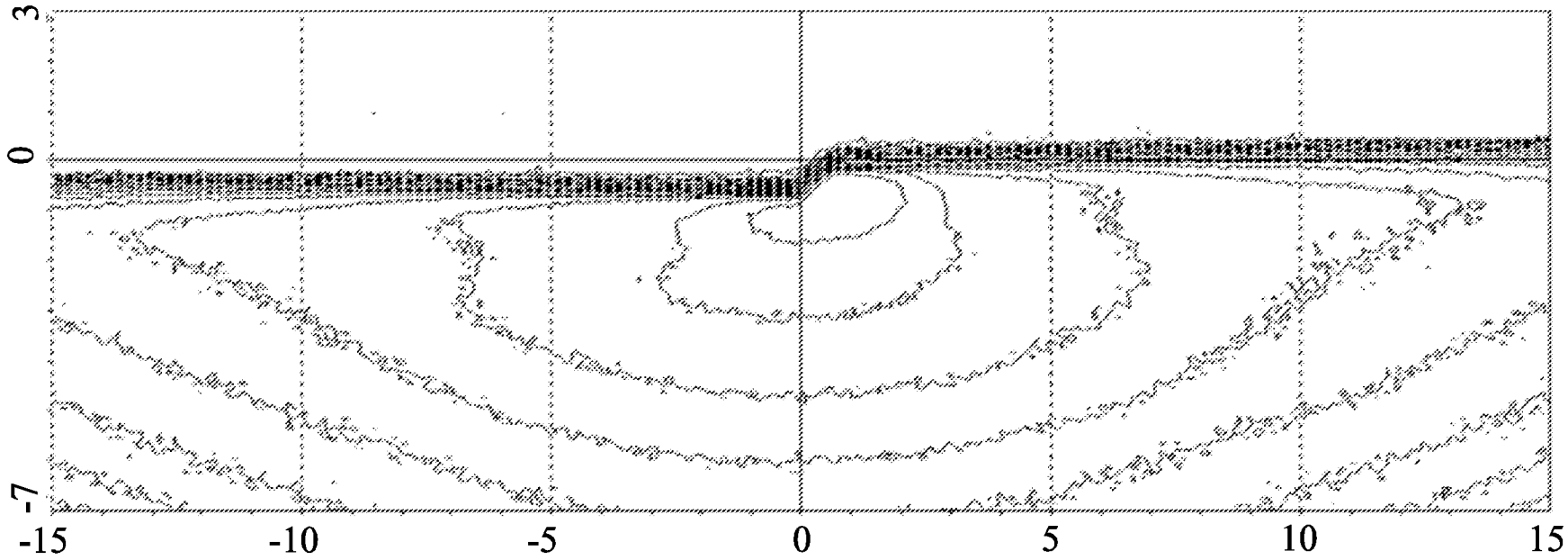
FIG. 7 is a light distribution pattern of a conventional vehicle lamp.
Figure 8:
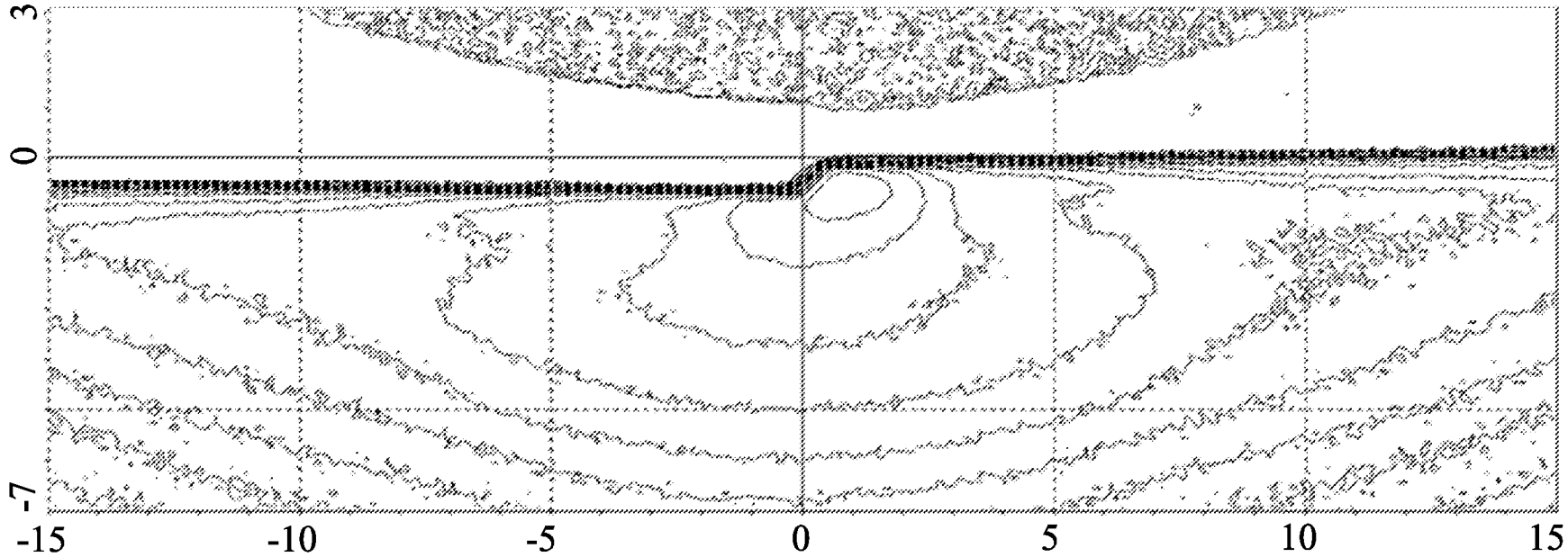
FIG. 8 is a light distribution pattern of the vehicle lamp of the disclosure.

A light distribution pattern of a conventional vehicle lamp without a grating plate 81 is shown in FIG. 7. In the regions proximal to the cutoff line, the light is more dispersed. A light distribution pattern of the embodiment is shown in FIG. 8. As a portion of light is reflected by the grating plate 81, the light rays proximal to the cutoff line are more concentrated, which reduces effects of stray light and chromatic dispersion around the cutoff line. Furthermore, as a portion of light incident on the grating plate 81 (represented by light ray (B)) is directed to and exits from the upper portion of the light exit surface 32 of the projector lens 3, forming a light pattern in a dark zone above the cutoff line, which allows regulations to be met for the testing point within Zone III (the dark zone) of Regulation No. 112 of the Economic Commission for Europe of the United Nations.

It should be noted that adjustments of the angle (θ) between the extension of the top portion of the grating plate 81 and the optical axis (X) only affects the light pattern of the dark zone and not the light pattern near the cutoff line. Further details are well known to those skilled in the art, and not described herein for the sake of brevity.

In sum, the benefits of the disclosure are as follows:

By using the grating plate 81 to reflect a portion of the light emitted by the light emitting member 7, effects of stray light and chromatic dispersion around the cutoff line are reduced. Furthermore, by adjusting the angle (θ) between the extension of the top portion of the grating plate 81 and the optical axis (X), brightness in the dark zone may be increased which allows the driver to see signs above the road with greater ease.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A vehicle lamp adapted to be installed on a vehicle, said vehicle lamp comprising:

a projector lens disposed on an optical axis which extends along a longitudinal direction of the vehicle, and having a light entry surface and a light exit surface that is opposite to said light entry surface;

a reflector disposed on the optical axis at a position which is behind a rear focal point of said projector lens;

a light emitting element being adjacent to a first focal point of said reflector which is distal from the rear focal point of said projector lens, and disposed for emitting light towards said reflector, such that the light is reflected by said reflector substantially toward a second focal point of said reflector which is proximate to the rear focal point of said projector lens, and to pass subsequently through said light entry surface and said light exit surface of said projector lens to form a light distribution pattern;

a shield for blocking a portion of the light that is emitted from said light emitting element to form a cut-off line in the light distribution pattern; and a grating plate disposed below the optical axis and in front of the rear focal point of said projector lens for reflecting at least a portion of the light that has traveled ahead of the second focal point of said reflector and that has not passed through said light exit surface of said projector lens, an extension of said grating plate and the optical axis defining an angle between 0 degree and 45 degrees.

2. The vehicle lamp as claimed in claim 1, wherein said light emitting element is disposed below the optical axis.

3. The vehicle lamp as claimed in claim 1, wherein a portion of light incident on said grating plate is directed to and exits from an upper portion of said light exit surface of said projector lens.

4. The vehicle lamp as claimed in claim 1, wherein said light emitting element is a light emitting diode constructed from at least one semi-conductor chip.

5. The vehicle lamp as claimed in claim 1, further comprising a heat dissipating member mounted with said reflector, said light emitting element and said shield.

6. The vehicle lamp as claimed in claim 1, wherein said grating plate is rotatable about a rotational axis which is normal to the optical axis.

7. The vehicle lamps as claimed in claim 6, wherein the angle between the extension of said grating plate and the optical axis is between 30° and 40°.

8. The vehicle lamp as claimed in claim 1, wherein said grating plate has a top surface, said top surface being one of a flat surface and a curved surface.

9. The vehicle lamp as claimed in claim 1, further comprising a lens holder mounted with said projector lens, said grating plate being substantially U-shaped and detachably and rotatably connected to said lens holder.

10. The vehicle lamp as claimed in claim 9, wherein said grating plate has two lateral portions that are directly and rotatably connected to said lens holder.

* * * * *